United States Patent [19]

Kvapil et al.

[11] 4,370,003

[45] Jan. 25, 1983

[54] TEMPORARY GAS SEAL FOR GAS LEVEL DRIFT OF AN IN SITU OIL SHALE RETORT

[75] Inventors: Rudolph Kvapil, Golden; Thomas E. Ricketts, Grand Junction, both of Colo.

[73] Assignee: Occidental Oil Shale, Inc., Grand Junction, Colo.

[21] Appl. No.: 202,467

[22] Filed: Oct. 31, 1980

[51] Int. Cl.[3] ..... E21C 41/10

[52] U.S. Cl. ..... 299/2; 299/12; 405/144; 98/50

[58] Field of Search ..... 299/2, 12; 405/144; 98/50; 137/68 R, 67; 251/294

[56] References Cited

U.S. PATENT DOCUMENTS

| | | | |
|---|---|---|---|
| 340,759 | 4/1886 | Brown | 405/144 |
| 1,804,692 | 5/1931 | Jackson | 299/2 |
| 4,023,372 | 5/1977 | Presler et al. | 405/144 X |
| 4,036,024 | 7/1977 | Dreker et al. | 405/144 X |
| 4,153,299 | 5/1979 | Kvapil et al. | 299/2 |

*Primary Examiner*—Ernest R. Purser

*Attorney, Agent, or Firm*—Christie, Parker & Hale

[57] ABSTRACT

A temporary gas seal is provided in a gas level drift of an in situ oil shale retort system which includes a production region having a panel of retorts producing gaseous and liquid products and an adjacent retort preparation region where a panel of in situ retorts is being prepared for production. A portion of the gas level drift is connected to the active retorts for withdrawing off gas while adjacent portions of the gas level drift are being developed. Portions of the gas level connected to the active retorts are temporarily sealed by a gas isolation barrier to isolate workers from toxic off gas. The gas isolation barrier can be a bulkhead with one or more openings each sealed by a remotely removable seal, such as a flexible membrane, or a plate that can be remotely removed or opened to unseal such a bulkhead opening. The procedure of temporarily sealing and thereafter opening newly developed portions of the gas level drift system can be repeated to provide stepwise development of the gas level drift system while retorting is carried out in adjacent production regions of the retort system.

26 Claims, 4 Drawing Figures

TEMPORARY GAS SEAL FOR GAS LEVEL DRIFT OF AN IN SITU OIL SHALE RETORT

BACKGROUND OF THE INVENTION

This invention relates to recovery of liquid and gaseous products from subterranean formations containing oil shale, and more particularly, to techniques for providing gas seals in a gas level drift system of an in situ oil shale retort system.

The presence of large deposits of oil shale in the semiarid high plateau Mountain region of the western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen," which, upon heating, decomposes to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery liquid and gaseous products from oil shale deposits has been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method for supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to product kerogen decomposition, called "retorting". Such decomposition in the oil shale produces gaseous and liquid products, including gaseous and liquid hydrocarbon products, and a residual solid carbonaceous material. The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas also can be withdrawn through a gas collection drift system at the bottom of the retort. The products of retorting are referred to herein as liquid and gaseous products.

The off gas may contain nitrogen, hydrogen, carbon monoxide, carbon dioxide, water vapor, methane, and other hydrocarbons, and sulfur compounds such as hydrogen sulfide. Carbon monoxide contained in the off gas is toxic. Hydrogen sulfide is an extremely toxic gas with a toxicity greater than that of hydrogen cyanide. It also possesses a powerful, objectionable odor with a threshold for human smell of about 0.0003 ppm.

The gas collection drift system can be dedicated to collecting off gas from active retorts in the producing region of the formation. That is, the gas collection drifts can be isolated or sealed off to avoid leakage of off gas into adjacent areas where personnel are working, as well as avoiding leakage of air and water into the gas level. Bulkheads can be installed at various locations in the gas collection drift system to keep the off gas sealed within the gas level.

One method of isolating the gas level is to excavate the entire gas collection drift system before retorting is initiated. However, this method is not economical because of the long lead time required in developing the gas level before production can begin. Portions of the gas level drift system can be developed in one region of a tract of retorts while retorting operations are carried on in another region of the retort tract. This is more economical than completing the entire gas level before retorting is started. However, precautions must be taken to ensure that workers in the retort development regions are not exposed to toxic off gas from active retorts in the production region.

It would be desirable to provide an off a gas seal for a gas level drift system that enables a portion of a gas collection drift system to be developed safely, while other mining activities, including retorting, are carried out in an adjacent region of the retort tract. It is also desirable to be able to remove or open such a seal at a later time to connect the gas collection drift system with a newly developed region, preferably from a remote location so that personnel are not exposed to toxic or noxious gases from the gas collection drift system.

SUMMARY OF THE INVENTION

According to one embodiment of the invention, a temporary off gas seal is positioned in a gas collection drift communicating with an in situ oil shale retort containing a fragmented permeable mass of formation particles containing oil shale. The temporary off gas seal comprises a gas isolation barrier sealed to the walls of the gas collection drift for sealing the side of the barrier opposite the fragmented mass against passage of off gas from the fragmented mass. At least one sealable gas flow passage extends through the gas isolation barrier. The sealable gas flow passage is closed by closure means, such as a flexible membrane which effectively inhibits passage of off gas from the side of the barrier adjacent the fragmented mass to the other side of the barrier. Such a flexible membrane is selectively releasable from its sealed position to open the gas flow passage and permit off gas to flow past the gas isolation barrier to a portion of the gas collection drift on the side of the barrier opposite the fragmented mass. Preferably, the flexible membrane can be unsealed from a remote location.

The gas isolation barrier in accordance with the principles of the present invention can be provided in a gas collection drift system for temporarily isolating retorts in a retort preparation region from active retorts in a production region. When positioned, the gas isolation barrier temporarily seals underground workings in the retort preparation region from toxic off gas from active retorts on one side of the barrier until newly formed retorts in the retort preparation region on the other side of the barrier are ready for production. When desired, the gas flow passage in the barrier can be unsealed from a safe, remote location and opened to permit gas flow through the barrier, so that a gas collection drift communicating with the newly formed retorts can be connected to a gas collection drift already communicating with the active retorts. Such a safe location can be provided, for example, behind a similar gas isolation barrier that can temporarily seal against passage of off gas from the newly connected portion of the gas collection drift. This process of temporarily sealing the gas collection drift and then opening passage of gas through a temporary gas isolation barrier can be repeated to permit development of in situ retorts while retorting is carried out in an adjacent region of the retort tract.

BRIEF DESCRIPTION OF THE DRAWINGS

These and other aspects of the invention will be more fully understood by referring to the following detailed description and the accompanying drawings in which.

DETAILED DESCRIPTION

Figure 1:
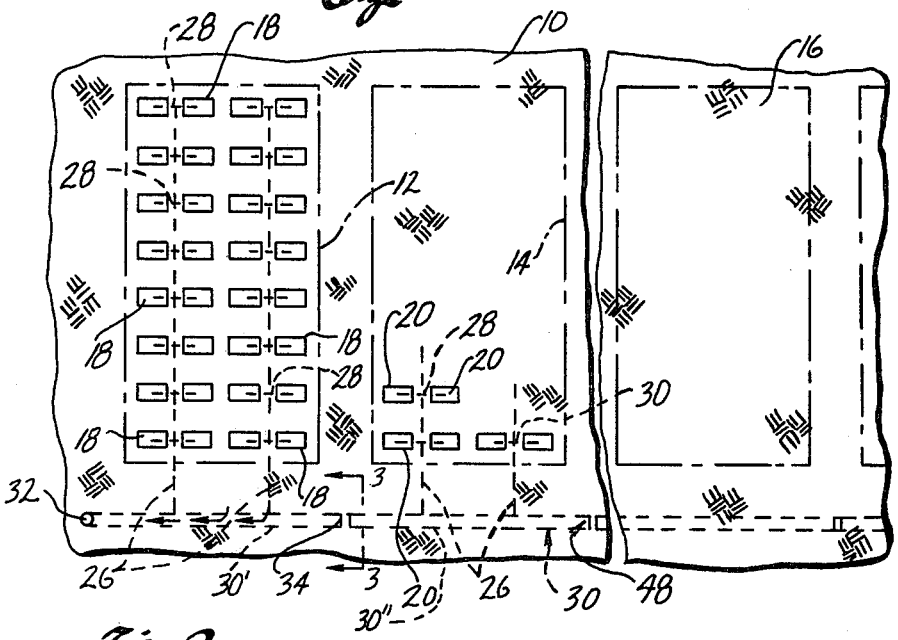
FIG. 1 is a fragmentary, semi-schematic horizontal cross-sectional view illustrating a system of in situ oil shale retorts having a gas collection drift system with removable gas seals according to principles of this invention.

Referring to FIG. 1, a development tract of a subterranean formation 10 containing oil shale has an in situ oil shale retort system which includes production of liquid and gaseous products in a production region 12 of the formation, retort preparation in an adjacent retort preparation region 14 of the formation, and a zone 16 of unfragmented formation adjacent the retort preparation region where future preparation or development of in situ retorts can be carried out.

It is desirable to develop in situ retorts in the retort preparation region simultaneously with production of liquid and gaseous products from active retorts in the adjacent production region. Generally speaking, the system of in situ retorts includes a separate gas collection level provided by a series of gas collection drifts for use in withdrawing toxic off gas from active retorts. The portion of the gas collection drift system connected to active retorts must be isolated or sealed from other mining activities in adjacent underground workings to prevent workers in those areas from being exposed to toxic off gas. According to this invention, a portion of the gas collection drift system can be developed, connected to active retorts in the production region, and isolated or sealed from other mining activities, including development of further gas collection drifts in the adjacent retort preparation region.

Figure 2:
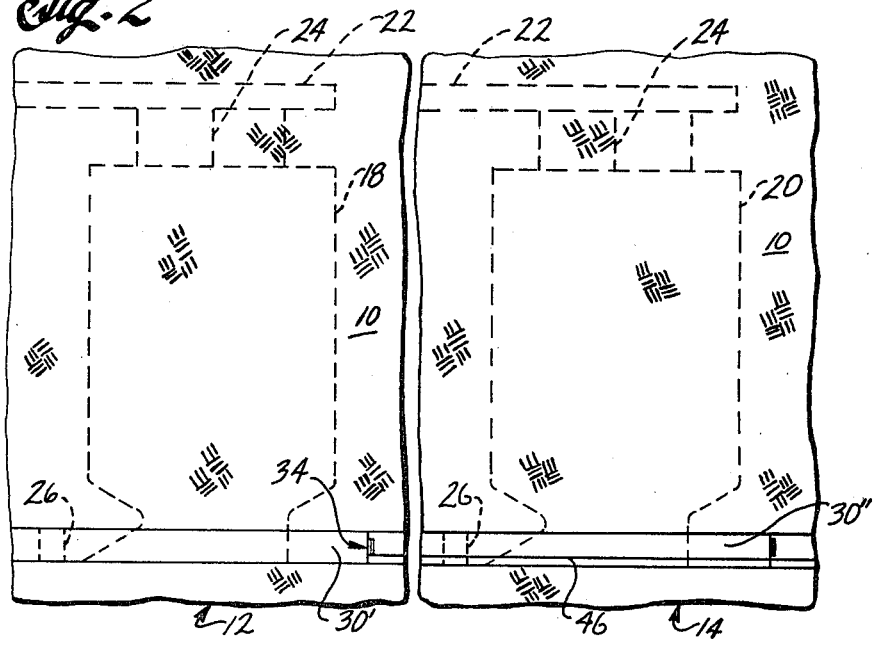
FIG. 2 is a fragmentary, semi-schematic vertical cross-sectional view illustrating an in situ oil shale retort system having a pair of spaced apart removable gas seals in a gas collection drift, with means for remotely opening one gas seal from a safe location behind the other gas seal.

The gas seal is described in the context of the exemplary embodiment illustrated in FIGS. 1 and 2, in which a group of active in situ oil shale retorts 18 is present within the production region 12. Another group of in situ oil shale retorts 20 is under development in the adjacent retort preparation region, although the group of retorts under development also can be located at substantial distance from the active retorts. The boundaries of the individual retorts 18 and 20 are illustrated schematically as small rectangular boxes in FIG. 1 for simplicity. As illustrated in FIG. 1, the group of active retorts 18 can be arranged in a plurality of mutually spaced apart, parallel rows, with a plurality of retorts being spaced apart from one another in each row. This arrangement can be referred to as a panel of retorts, and the retorts in this region can be referred to herein as a first panel of retorts. The retorts in the adjacent retort preparation region are shown being arranged in a pattern similar to that of the active retorts, and the retorts in the retort preparation region can be referred to herein as a second panel of retorts. The retorts in the second panel also can be completely rubblized.

Each retort in the production region contains a fragmented permeable mass of formation particles containing oil shale. Many techniques are available to prepare such a retort; for example, formation from within the boundaries of an in situ oil shale retort site can be excavated to form at least one void within the retort site, leaving a zone of unfragmented formation within the boundaries of the retort site adjacent such a void. The zone of unfragmented formation is explosively expanded toward such a void to form the fragmented mass. Various other techniques for forming such a fragmented mass are described in the patents incorporated by reference above. Other techniques are well known to those skilled in the art.

With reference to FIG. 2, and for purposes of illustrating an application of the present invention, the panel of retorts in the production region is connected to an air level drift system 22 excavated at a level spaced above the boundaries of the retorts. A plurality of feed gas inlet passages 24 can be drilled downwardly from the air level drift as shown, or from the surface, to the upper boundary of each in situ retort in the production region, and oxygen-containing gas can be supplied to the fragmented mass of each retort from the feed gas inlet passages during production operation. Alternatively, the inlet passages can be drilled downwardly from the surface or from a drift adjacent the retort.

The in situ retorts in the production region of the illustrated example also are connected to a production level drift system spaced below the lower boundaries of the retorts. The arrangement of the production level drift system can vary. In the illustrated example, the production level drift system includes a number of production level cross-drifts 26 for collecting liquid and gaseous products produced from the retorts during production operation. Stub drifts 28 convey liquid and gaseous products from each in situ retort to corresponding cross-drifts. The cross-drifts convey both liquid and gaseous products to a main liquid collection drift (not shown) which can be at an outer boundary of the development site, and to a separate main gas collection drift 30, which also can be at the boundary of the development site. Liquid products are withdrawn to above-ground from the main liquid collection drift. Gaseous products are drawn from the production level cross-drifts to the main gas collection drift and passed to above-ground through a gas withdrawal shaft 32. Alternatively, a drift system for collection of gaseous products separately from collection of liquid products can, if desired, be excavated at a gas level spaced below a separate drift system for collecting liquid products.

During the production operation, a combustion zone is established in retorts within the production region. During retorting, formation particles at one end of the fragmented mass of such a retort are ignited to establish a combustion zone at the top of the fragmented mass. Air or other oxygen-supplying gas introduced into the combustion zone through the passages 24 drilled to the fragmented mass sustains the combustion zone and advances it downwardly through the fragmented mass. Hot gas from the combustion zone flows through the fragmented mass on the advancing side of the combustion zone to a retorting zone where kerogen in the fragmented mass is converted to liquid and gaseous products. The liquid products and an off gas containing gaseous products pass to the production level drift system, from which the liquid products and off gas are withdrawn via the main liquid and gas collection drifts, respectively. The off gas can contain toxic compounds, such as carbon monoxide and hydrogen sulfide, and workers in the retort preparation region must be isolated from such toxic off gas. The temporary gas seal according to principles of this invention provides such isolation.

In one embodiment, the temporary gas seal comprises a gas isolation barrier 34 affixed in a portion of the main gas collection drift 30. The portion of the main gas collection drift where the first gas isolation barrier is installed, as illustrated, also communicates with production level crossdrifts 26 leading from the panel of retorts being developed in the adjacent retort preparation region. The gas isolation barrier is sealed to the wall of the gas collection drift, in a manner described below, to prevent off gas from passing through the barrier from the active retort side 30' of the main gas collection drift to the temporarily sealed or isolated side 30'' of the main gas collection drift. If required, gas seals also are provided at other locations in the production level drift system for isolating underground workings in the retort preparation region from off gas produced from active retorts in the production region.

Figure 3:
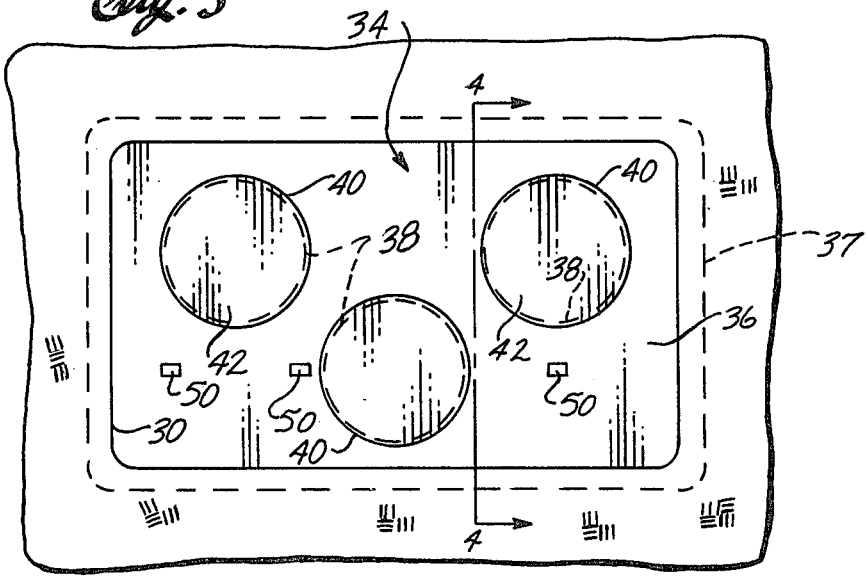
FIG. 3 is a fragmentary, semi-schematic vertical cross-sectional view taken on line 3—3 of FIG. 1 and showing a removable gas seal according to principles of this invention.
Figure 4:
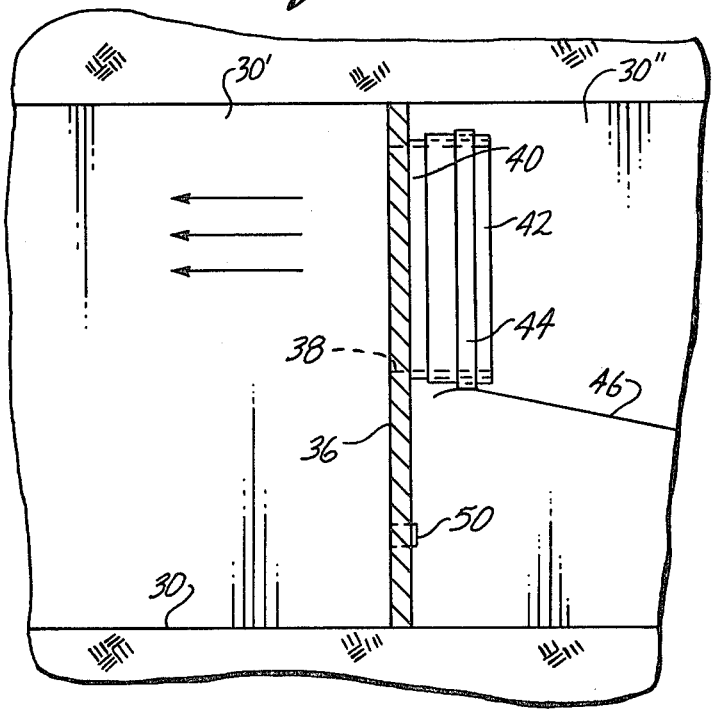
FIG. 4 is a fragmentary, semi-schematic vertical cross-sectional view taken on line 4—4 of FIG. 3.

As shown in FIGS. 3 and 4, the gas isolation barrier can be a bulkhead 36 comprising a rigid, planar steel plate anchored and sealed around its periphery to the wall surrounding the main gas collection drift. The periphery of the bulkhead can be anchored and sealed in a peripheral slot 37 cut into the floor, roof and side walls of formation surrounding the drift. A gas impervious material such as "Shotcrete" can be used to seal the periphery of the bulkhead to the walls of the formation surrounding the drift. The bulkhead closes off and seals the cross-sectional area of the drift, except for one or more gas flow passages 38 formed in the bulkhead plate. Although a variety of sizes, shapes and arrangements of the gas flow passages can be used, in the illustrated embodiment, three mutually spaced apart, generally circular gas flow passages 38 extend through the bulkhead. A separate annular lip 40 extends around the periphery of each gas flow passage. Each lip projects away from the face of the bulkhead opposite the portion of the gas collection drift communicating with active retorts in the production region.

Closure means are provided for releasably closing each gas flow passage for temporarily sealing against flow of off gas through the passages in the bulkhead. Such closure means can vary, and in the illustrated embodiment, the closure means comprises a separate flexible membrane 42 closing each gas flow passage in the bulkhead. Each flexible membrane is preferably oversized with respect to its corresponding gas flow passage, so that an annular peripheral portion of the membrane overlaps the annular outside surface of the lip surrounding the passage.

A separate removable seal ring 44 is fastened to the overlapping portion of each membrane for releasably securing and sealing each membrane to its corresponding annular lip. The seal ring can be a belt, a stretchable gasket, or a similar annular piece of material that extends around the overlapping annular portion of the membrane. The seal ring is tightened or otherwise exerts frictional pressure around the membrane for tightly securing it to the lip surrounding each passage for providing a gas seal that inhibits flow of off gas through the passage from the active retort side of the bulkhead.

The membrane is preferably made of flexible and foldable material, such a rubber or plastic, capable of resisting the highest temperatures commonly encountered in such a gas collection drift from off gas from active in situ oil shale retorts. Generally, these temperatures are on the order of about 400° F. The flexible membrane also helps absorb airblast from adjacent mining development. Rubber-like materials resistant to hydrocarbon degradation and the range of temperatures encountered can be used for such flexible membranes. As an alternative embodiment, a pair of such flexible membranes can be similarly attached to the lip surrounding each opening, and a fluid can be circulated between the two membranes for cooling, if desired. The seal ring or belt also is preferably made from a flexible material that is resistant to the same elevated temperatures as the membrane.

Each gas flow passage can be opened remotely when desired. For example, the passages in the bulkhead are opened to connect the previously isolated side 30'' of the gas collection drift to the active retort side 30' of the drift. Each gas flow passage in the bulkhead is opened by removing the belt from the lip surrounding the gas flow passage. In the illustrated embodiment, a separate elongated cable or tension line 46 is secured to each belt, and the cable extends away from the side of the bulkhead opposite the active retorts. The cable can be pulled to apply sufficient tension to the belt in a direction away from the bulkhead for removing the belt from the lip surrounding the gas flow passage. This leaves the flexible membrane unsupported and allows the membrane to be pulled through the gas flow passage onto the floor of the drift, to open the gas flow passage. The membrane is drawn through the gas flow passage owing to a pressure differential and the resultant off gas flow in the gas collection drift, which flows away from the bulkhead toward the active retorts, as indicated by the arrows in FIG. 4.

Other arrangements can be used for providing a gas-tight closure for each gas flow opening and for removing or opening such a gas-tight closure. For example, such a closure can be provided by a separate rigid imperforate plate or door covering each passage in the bulkhead. The plate or door can pivot open or otherwise can be moved to a position that opens the gas flow passage, or such a closure can be removed entirely from the bulkhead for opening the gas flow passage.

Since the gas flow passages can be independently opened, gas flow through the bulkhead can be controlled. The off gas side of the bulkhead is at a relatively lower gas pressure than the oxygen side of the bulkhead. Opening the gas flow passage causes air to flow from the oxygen side to the off gas side of the bulkhead. The larger the total cross-sectional area for gas flow provided by the gas flow passages, the greater the flow of oxygen from the safe side of the bulkhead into the off gas volume on the opposite side of the bulkhead. By opening the gas flow passages one at a time, the flow of oxygen into the off gas volume can be increased progressively, and therefore carefully controlled. By opening all gas flow passages at the same time, or by opening a single large opening in the bulkhead, the flow of oxygen into the off gas mixture might be so large as to form an explosive gas mixture. In the illustrated embodiment, each gas flow opening occupies a minor portion of the total cross-sectional area to gas flow through the drift, and collectively, the gas flow passages occupy approximately at least about half the total cross-sectional area of the bulkhead. By opening each passage separately, the bulkhead openings can act as a valve or metering device for progressively increasing flow of gas through the bulkhead. The total cross-sectional area to gas flow provided by all gas flow passages, when open, is sufficient to accommodate the final gas flow rates necessary in the gas handling system of the active retort system. In the illustrated embodiment, the total area occupied by the three gas flow passages is believed to be sufficient to avoid undue restriction on gas flow rates necessary for properly operating the retort system. Additional area can be provided with additional openings.

A plurality of such gas isolation barriers can be used in a mining scheme for a retort development tract. In the illustrated embodiment, a first temporary gas seal can be provided by installing the gas isolation barrier 34 in the portion of the main gas collection drift between the first panel of retorts in the production region and the second panel of retorts being developed in the adjacent retort preparation region; however, the gas isolation barrier also could be placed in other locations in the gas collection drift downstream from the first panel of retorts. The gas flow passages in the first gas flow barrier 34 are sealed, and when retorts in the first panel are completed, retorting can be initiated in the first panel of retorts. The first gas isolation barrier seals against the flow of toxic off gas from active retorts in the first panel into the second panel of retorts, which can be developed simultaneously while retorting operations take place in the first panel.

A second gas isolation barrier 48 similar to the first gas isolation barrier 34 can be installed in the main gas collection drift between its connection to retorts in the second panel and its connection to retorts in a third panel developed in the adjacent zone 16 of unfragmented formation. When retorts in the second panel are completed and ready for retorting, the gas flow passages through the second gas isolation barrier are sealed, and gas flow passages in the first gas isolation barrier are opened, for connecting the gas level drift system of the second panel to the gas level drift system of the first panel.

The gas flow passages in the first gas isolation barrier are remotely opened from the safe side of the second gas isolation barrier, i.e., from the side of the second gas isolation barrier opposite the first gas isolation barrier. A variety of arrangements can be used for remotely opening the gas flow passages from a safe location spaced from the gas isolation barrier. In the illustrated embodiment, each cable 46 passes through a corresponding man-sized door 50 in the next bulkhead. Each door is temporarily opened to allow the cables to pass through the door openings to the safe side of the bulkhead. After the cables are pulled to remove the membranes and open the gas flow passages through the first bulkhead, the doors can be closed for sealing against the passage of off gas through the second barrier. Gas flow in the gas collection drift is normally pulling away from the second bulkhead, so that time is available to close each door before significant exposure to off gas.

Thus, part of the gas level system can be developed, and then isolated from the rest of the mining activities, including development of the remaining gas level drifts. The gas isolation barrier can then be opened when the next section is ready to be tied to the gas collection system. Another similar gas isolation barrier can be used to separate the mining activities from sections of the gas level containing toxic off gas. This new barrier can be opened remotely when the next section of retorts is ready for initiation of retorting. This process of opening bulk-heads in series incrementally can be repeated throughout the retort development site.

What is claimed is:

1. An off gas seal for a gas collection drift communicating with and extending away from an in situ oil shale retort containing a fragmented permeable mass of formation particles containing oil shale in a subterranean formation containing oil shale, the off gas seal comprising:

a rigid gas isolation barrier sealed at its periphery to the walls of the gas collection drift;

at least one gas flow passage extending through the rigid gas isolation barrier;

a flexible membrane for closing such gas flow passage for inhibiting passage of off gas through the gas flow passage and past the gas isolation barrier from a side of the gas isolation barrier adjacent the fragmented mass to a side of the barrier opposite the fragmented mass;

fastening means sealing the flexible membrane to the gas isolation barrier for supporting the membrane on the barrier for closing such gas flow passage; and means for unsealing such flexible membrane from the gas isolation barrier for removing the support of the flexible membrane on the barrier for opening such gas flow passage for permitting passage of off gas through the open gas flow passage to a portion of the gas collection drift on the side of the gas isolation barrier opposite the fragmented mass.

2. Apparatus according to claim 1 in which the fastening means includes a flexible seal releasably securing the membrane to the gas isolation barrier for sealing the membrane over such gas flow passage.

3. Apparatus according to claim 2 in which the means for unsealing such flexible membrane comprises means for removing the flexible seal from engagement with the membrane.

4. Apparatus according to claim 3 further including a lip extending around such gas flow passage and projecting from the face of the barrier opposite the fragmented mass; and wherein the flexible seal fastens a peripheral portion of the membrane to the lip around such gas flow passage.

5. Apparatus according to claim 4 in which the means for unsealing such flexible membrane comprises means for releasing the seal to remove the membrane from the lip around the gas flow passage.

6. Apparatus according to claim 3 in which the means for unsealing such flexible membrane comprises an elongated cable means secured to the flexible seal so that force exerted on the cable means removes the seal from engagement with the membrane.

7. Apparatus according to claim 1 including a plurality of such gas flow passages extending through the rigid gas isolation barrier, each gas flow passage being sealed by a separate one of said flexible membranes; and means for independently unsealing each flexible membrane.

8. Apparatus according to claim 1 in which the flexible membrane is on a side of the rigid gas isolation barrier opposite the fragmented mass; and in which the fastening means is removable from the side of the barrier opposite the fragmented mass for unsealing the flexible membrane.

9. Apparatus according to claim 1 in which the fastening means includes a flexible seal for supporting the membrane on the barrier over the gas flow passage; and in which the unsealing means comprises means for removing the flexible seal to remove the support of the membrane on the barrier.

10. A selectively removable gas seal in a subterranean drift, comprising:

a rigid bulkhead sealed at its periphery to the walls of the drift;

at least one gas flow passage through the rigid bulkhead;

a flexible membrane closing each gas flow passage for inhibiting passage of gas through such gas flow passage from one side of the bulkhead to the other side of the bulkhead;

fastening means securing the flexible membrane to the bulkhead for maintaining the flexible membrane in a closed position sealing the gas flow passage; and means for removing the fastening means from the bulkhead for removing the membrane from its closed position for permitting passage of off gas through such gas flow passage from one side of the bulkhead to the other side of the bulkhead.

11. Apparatus according to claim 10 in which such means for removing the fastening means is operable remotely from a location in the drift spaced from the bulkhead.

12. Apparatus according to claim 10 in which a plurality of such gas flow passages individually occupy a minor portion of the area of the bulkhead, and collectively occupy a major portion of the area to the bulkhead.

13. Apparatus according to claim 10 in which the fastening means includes a flexible seal releasably securing such membrane to the bulkheads and sealing the membrane around such gas flow passage for maintaining the membrane in its closed position.

14. Apparatus according to claim 13 in which the means for removing the fastening means comprises separate elongated cable means secured to the flexible seal for use in remotely removing the flexible seal from the bulkhead.

15. An off gas seal for a gas collection drift in a subterranean formation containing oil shale, the gas collection drift communicating between a fragmented permeable mass of formation particles containing oil shale and underground workings in a retort preparation zone of such a subterranean formation containing oil shale, the off gas seal comprising:

a first gas isolation barrier sealed to the walls of the gas collection drift between the fragmented mass and the underground workings; the first gas isolation barrier having at least one gas flow passage extending through it, and first selectively removable closure means sealing such gas flow passage from the passage of gas from the fragmented mass through such a gas flow passage in the first gas isolation barrier;

a second gas isolation barrier spaced from the first gas isolation barrier and sealed to the walls of the gas collection drift on a side of the first gas isolation barrier opposite the fragmented mass; the second gas isolation barrier having at least one gas flow passage extending through it, and second removable closure means sealing against passage of gas through such a passage in the second gas isolation barrier; and means for removing such first closure means for opening such a first gas flow passage in the first gas isolation barrier to permit passage of gas through the first gas flow passage to a portion of the gas collection drift adjacent the second gas isolation barrier, said first closure means being removable remotely from a side of the second gas isolation barrier opposite the first gas isolation barrier.

16. Apparatus according to claim 15 including an elongated cable means secured to the means for removing said first closure means, such that force applied to the cable means releases the first closure means for opening the first gas flow passage.

17. Apparatus according to claim 15 in which such closure means comprise a flexible membrane covering such a gas flow passage.

18. Apparatus according to claim 17 including a flexible seal engaging the membrane for sealing the membrane over the gas flow passage.

19. Apparatus according to claim 18 in which the means for removing the first closure means comprises a tension line to which tension can be applied for removing the flexible seal from engagement with the flexible membrane.

20. Apparatus according to claim 17 including a lip extending around such a gas flow passage and projecting from a face of such a gas isolation barrier opposite the fragmented mass; wherein such flexible membrane is releasably secured to such a lip around such gas flow passage.

21. A method for selectively sealing a gas collection drift formed in a subterranean formation containing oil shale, in which the gas collection drift communicates between an in situ oil shale retort containing a fragmented permeable mass of formation particles containing oil shale and underground workings in an adjacent retort preparation zone of such a subterranean formation containing oil shale, the method comprising the steps of:

sealing a first gas isolation barrier to such a gas collection drift between the fragmented mass and the underground workings; the first gas isolation barrier having at least one gas flow passage extending through it, and removable closure means for temporarily sealing such gas flow passage;

establishing a retorting zone in the fragmented mass and advancing the retorting zone through the fragmented mass to generate liquid and gaseous products of retorting, such closure means of the first gas isolation barrier inhibiting flow of such gaseous products through the gas collection drift from the fragmented mass toward the underground workings;

sealing a second gas isolation barrier to a portion of the collection drift spaced from a side of the first gas isolation barrier opposite the fragmented mass;

providing a remotely actuated means for removing the closure means from the first gas isolation barrier from a location in the gas collection drift on a side of the second gas isolation barrier opposite the first gas isolation barrier;

removing such closure means for opening such gas flow passage through the first gas isolation barrier to provide gas communication between the fragmented mass and the underground workings through the first gas isolation barrier, such closure means being removed by actuating said removal means remotely from a location in the gas collection drift on a side of the second gas isolation barrier opposite the first gas isolation barrier; and withdrawing the liquid and gaseous products of retorting.

22. The method according to claim 21 in which the first gas isolation barrier includes a plurality of such gas flow passages, each passage having said closure means and said removal means; and including independently actuating said removal means for removing said closure means from their corresponding gas flow passages.

23. The method according to claim 22 including removing at least two of said closure means at different times.

24. An off gas seal for a gas collection drift in a subterranean formation containing oil shale, the gas collection drift communicating between a fragmented permeable mass of formation particles containing oil shale and underground workings in a retort preparation zone of such a subterranean formation containing oil shale, the off gas seal comprising:

a first gas isolation barrier sealed to the walls of the gas collection drift between the fragmented mass and the underground workings; the first gas isolation barrier having at least one gas flow passage extending through it, and first selectively removable closure means sealing such gas flow passage from the flow of gas from the fragmented mass through such a gas flow passage in the first gas isolation barrier;

a second gas isolation barrier spaced from the first gas isolation barrier and sealed to the walls of the gas collection drift on a side of the first gas isolation barrier opposite the fragmented mass; the second gas isolation barrier having at least one gas flow passage extending through it, and second removable closure means sealing against the flow of gas through such a passage in the second gas isolation barrier;

means for removing such first closure means for opening such a first gas flow passage in the first gas isolation barrier to permit the flow of gas through the first gas flow passage to a portion of the gas collection drift adjacent the second gas isolation barrier, said first closure means being removable remotely from a side of the second gas isolation barrier opposite the first gas isolation barrier;

an elongated cable means secured to the means for releasing said first closure means, such that force applied to the cable means releases the closure means for opening the first gas flow passage, at least one of the gas isolation barriers including a cable opening through which the cable means extends to the opposite side of the barrier; and means for sealing said cable opening.

25. A method for selectively sealing a gas collection drift formed in a subterranean formation containing oil shale, in which the gas collection drift communicates between an in situ oil shale retort containing a fragmented permeable mass of formation particles containing oil shale and underground workings in an adjacent retort preparation zone of such a subterranean formation containing oil shale, the method comprising the steps of:

sealing a first gas isolation barrier to such a gas collection drift between the fragmented mass and the underground workings; the first gas isolation barrier having at least one gas flow passage extending through it, and removable closure means for temporarily sealing such gas flow passage;

establishing a retorting zone in the fragmented mass and advancing the retorting zone through the fragmented mass to generate liquid and gaseous products of retorting, such closure means of the first gas isolation barrier inhibiting flow of such gaseous products through the gas collection drift from the fragmented mass toward the underground workings;

sealing a second gas isolation barrier to a portion of the gas collection drift spaced from a side of the first gas isolation barrier opposite the fragmented mass;

providing a tension line extending from such closure means through the second gas isolation barrier;

removing such closure means for opening such gas flow passage through the first gas isolation barrier to provide gas communication between the fragmented mass and the underground workings through the first gas isolation barrier, such closure means being removed by applying tension to the tension line remotely from a location in the gas collection drift on a side of the second barrier opposite the first barrier to remove the closure means; and withdrawing the liquid and gaseous products of retorting.

26. The method according to claim 25 in which the tension line passes through an opening in the second barrier; and including sealing the opening in the second barrier after tension is applied to the tension line to remove such closure means.

* * * * *